US006214453B1

(12) United States Patent
Kano

(10) Patent No.: US 6,214,453 B1
(45) Date of Patent: Apr. 10, 2001

(54) DECORATIVE SHEET FOR EXTERIOR WALL SURFACE

(75) Inventor: Hiromichi Kano, Okayama (JP)

(73) Assignee: Toyokasei Co., Ltd., Okayama (JP)

( * ) Notice: Subject to any disclaimer, the term of this patent is extended or adjusted under 35 U.S.C. 154(b) by 0 days.

(21) Appl. No.: 08/375,507

(22) Filed: Jan. 18, 1995

Related U.S. Application Data

(63) Continuation of application No. 08/123,046, filed on Sep. 20, 1993, now abandoned.

(30) Foreign Application Priority Data

Oct. 19, 1992 (JP) ..... 4-305973

(51) Int. Cl.[7] ..... B32B 7/14

(52) U.S. Cl. ..... 428/245; 428/325; 428/327; 428/212; 428/40.1; 428/202; 428/904.4; 428/906; 428/352; 428/354; 428/261; 428/95; 428/96; 428/246

(58) Field of Search ..... 428/245, 325, 428/327, 212, 40.1, 202, 904.4, 906, 352, 354, 261, 95, 96, 246

(56) References Cited

U.S. PATENT DOCUMENTS

| | | | | |
|---|---|---|---|---|
| 4,355,074 | * | 10/1982 | Stemmler et al. | 428/358 |
| 4,393,115 | * | 7/1983 | Yoshii et al. | 428/323 |
| 4,429,000 | * | 1/1984 | Naka et al. | 428/265 |
| 4,632,860 | * | 12/1986 | D'Antonio et al. | 428/290 |
| 4,636,424 | * | 1/1987 | Amemiya et al. | 428/198 |
| 4,650,704 | * | 3/1987 | Rothenberg | 428/40 |
| 4,762,680 | * | 8/1988 | Pennace et al. | 428/40 |
| 5,071,704 | * | 12/1991 | Fishel-Ghodsian | 428/354 |
| 5,151,318 | * | 9/1992 | Strasilla et al. | 428/246 |
| 5,277,954 | * | 1/1994 | Carpenter et al. | 428/71 |

FOREIGN PATENT DOCUMENTS

| | | |
|---|---|---|
| 0151963 | 8/1985 | (EP) . |
| 1075276 | 7/1967 | (GB) . |
| 1239430 | 7/1971 | (GB) . |
| 1458444 | 12/1976 | (GB) . |
| 2108867 | 5/1983 | (GB) . |
| 2114585 | 8/1983 | (GB) . |

OTHER PUBLICATIONS

Rose, The Condensed Chemical Dictionary, 1966, pp. 842–843.*

* cited by examiner

*Primary Examiner*—Michael A. Williamson
(74) *Attorney, Agent, or Firm*—Micheal D. Bednarek; Shaw Pittman

(57) ABSTRACT

A decorative sheet for an exterior wall surface is provided which comprises a flexible nonwoven fabric which is permeable to air and moisture, and a coating layer formed on a front surface of the nonwoven fabric, the coating layer being also flexible and permeable to air and moisture after drying. The coating layer may be releasably covered by a stretchable plastic film. Further, the nonwoven fabric may have a rear surface formed with an air- and moisture-permeable adhesive layer which is covered by a releasable paper.

9 Claims, 3 Drawing Sheets

DECORATIVE SHEET FOR EXTERIOR WALL SURFACE

This application is a continuation of application Ser. No. 08/123,046 filed Sep. 20, 1993, now abandoned.

BACKGROUND OF THE INVENTION

1. Field of the Invention

The present invention relates to a decorative sheet which is affixed to an exterior wall surface for decorative and protective purposes.

2. Description of the Prior Art

Conventionally, an exterior wall surface of a building is most typically treated by directly applying a painting or coating material to the surface by means of a spray gun. However, the spray gun method is likely to result in poor appearance due to unevenness of the coating thickness and/or color in addition to giving rise to a pollution problem. Further, the spray gun method is also disadvantageous in that the coating work is greatly influenced by the weather.

To solve the problems of the spray gun method, it has been proposed to use decorative sheets for covering an exterior wall surface of a building. Various kinds of exterior decorative sheets are known, but they are equally impermeable to air and moisture. Indeed, due to the outside use (particularly in consideration of rain), the designing emphasis is placed mainly on durability, and no or little attention has been ever paid to the necessity of imparting an air- and moisture-permeability to the exterior decorative sheet, as opposed to a decorative cloth for an interior wall surface.

When such a decorative sheet is affixed to an exterior wall surface, there is a tendency of locally trapping air between the sheet and the wall surface due to its inability of allowing air passage. As a result, the sheet will be locally bulged in addition to being likely to come off the wall surface. This problem becomes particularly remarkable when the exterior wall surface has projections and depressions.

Further, the prior decorative sheet is known to be relatively hard and heavy. As a result, it is rather difficult to adapt the sheet to corner or bent or undulated portions of an exterior wall surface, and the sheet is likely to displace gravitationally on a vertical wall surface.

SUMMARY OF THE INVENTION

It is, therefore, an object of the present invention to provide a decorative sheet which can be conveniently affixed to an exterior wall surface, even corner or bent or undulated portions thereof, without trapping air between the sheet and the wall surface, thereby providing an improved appearance while also preventing unexpected removal from the wall surface.

According to the present invention, there is provided a decorative sheet for a wall surface comprising a flexible nonwoven fabric which is permeable to air and moisture, and a coating layer formed on a front surface of the nonwoven fabric, the coating layer being also flexible and permeable to air and moisture after drying.

The nonwoven fabric may be preferably made of at least one material selected from the group consisting of polyester fibers, polypropylene fibers, polyethylene fibers, nylon fibers, acrylic fibers, rayon fibers, acetate fibers and vinylon fibers.

On the other hand, the coating layer may be advantageously made of a coating material which is prepared by mixing at least one matrix with at least one additive. The matrix may be preferably selected from the group consisting of acrylic resin, copolymerized acrylic rubber, copolymerized butadiene rubber, vinyl resin, urethane resin, silicone resin and flurocarbon resin, whereas the additive may be preferably selected from the group consisting of natural stone powder, fine particles of natural stone, artifitially colored particles of natural stone, fine particles of foaming agent, ceramic powder, glass powder, fine plastic particles and pigment.

In one embodiment of the present invention, the coating layer is releasably covered by a stretchable plastic film, so that the coating layer is prevented from being soiled or stained at the time of affixing the decorative sheet. Further, the nonwoven fabric has a rear surface formed with a uniform adhesive layer which is permeable to air and moisture, and the adhesive layer is covered by a releasable paper layer.

In another embodiment, the nonwoven fabric has a rear surface which may be formed with a mesh adhesive pattern. Alternatively, the rear surface of the nonwoven fabric is formed with a comblike adhesive pattern or a stripe adhesive pattern.

Other objects, features and advantages of the present invention will be clearly understood from the following description of a preferred embodiment given with reference to the accompanying drawings.

DESCRIPTION OF THE PREFERRED EMBODIMENTS

Figure 1:
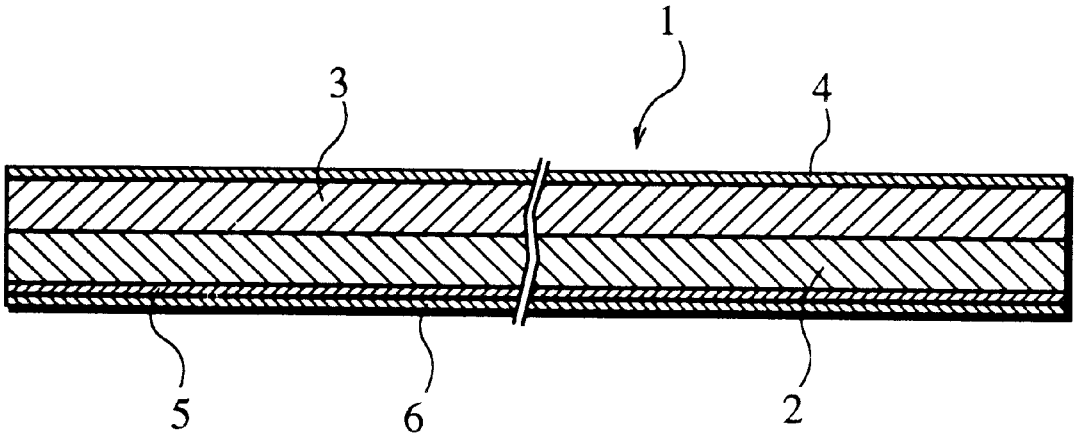
FIG. 1 is a sectional view showing a decorative sheet according to an embodiment of the present invention.

Referring first to FIG. 1 of the accompanying drawings, a decorative sheet 1 according to a preferred embodiment of the present invention comprises a nonwoven fabric 2 having a front surface covered by a coating layer 3 which is in turn covered by a releasable (peelable) plastic film 4. The nonwoven fabric 2 has a rear surface covered by an adhesive layer 5 which is in turn covered by a releasable (peelable) paper layer 6. The decorative sheet 1 may be manufactured and cut in a predetermined shape at the factory.

The nonwoven fabric 2 is of the needled type and has a number of pores (not shown) similarly to a woven fabric. Thus, the non-woven fabric 2 is not only flexible but also permeable to air and moisture. The nonwoven fabric 2 may be made of at least one material selected from the group consisting of polyester fibers, polypropylene fibers, polyethylene fibers, nylon fibers, acrylic fibers, rayon fibers, acetate fibers and vinylon fibers.

The thickness of the nonwoven fabric 2 is preferably in the range of 0.5–3.0 mm. If the thickness is less than 0.5 mm, the nonwoven fabric 1 not only lacks durability in itself but also fails to impart a sufficient resistance against crack formation to the wall surface to which the decorative sheet 1 is applied. If the thickness is larger than 3.0 mm, on the other hand, the nonwoven fabric 1 becomes too costly and fails to have an enough flexibility required for facilitating affixture to the wall surface at corner portions thereof.

The coating layer 3 also must be flexible and permeable to air and moisture after drying. A suitable coating material for the coating layer 3 may be prepared by mixing at least one matrix selected from acrylic resin, copolymerized acrylic rubber, copolymerized butadiene rubber, vinyl resin, urethane resin, silicone resin and flurocarbon resin with at least one additive selected from natural stone powder, fine particles of natural stone, artifitially colored particles of natural stone, fine particles of foaming agent, ceramic powder, glass powder, fine plastic particles and pigment, and the selection may be made depending on the intended or desired surface design. It should be appreciated that the coating layer 3 is rendered permeable to air and moisture by inclusion of the above-mentioned additive.

The formation of the coating layer 3 may be performed at the factory by applying a suitable coating material to the front surface of the nonwoven fabric 2 by using an automatic spray gun or a painting robot, and the coating material thus applied is dried for curing under a controlled temperature and ventilation condition. The thickness, after drying, of the coating layer 3 may be preferably in the range of 0.5–3.0 mm. A thickness less than 0.5 mm results in poor durability of the coating layer 3. On the other hand, a thickness larger than 3.0 mm leads to unacceptable prolongation of the coating application time.

The plastic film 4 is stretchable and has a thickness of not more than 0.3 mm. Suitable materials for the film 4 include polyvinyl and polyethylene for example. The film 4 may be peelably affixed to the coating layer 3 by a suitable adhesive.

The adhesive layer 5, which may be not more than 0.5 mm in thickness, is a uniform layer which may be made of a contact adhesive (pressure-sensitive adhesive) such as acrylic adhesive or butadiene-family adhesive. Since the adhesive matrix material for the layer 5 itself is not permeable to air and moisture, the uniform adhesive layer 5 may be rendered air- and moisture-permeable by including at least one of fiber fragments and pigment in the adhesive matrix material.

Figure 2:
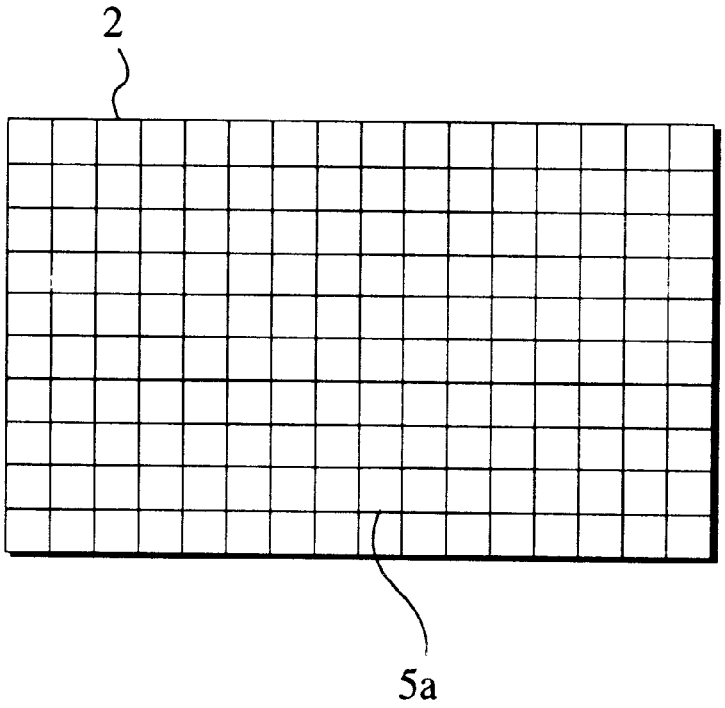
FIG. 2 is a bottom view showing a mesh adhesive pattern used for affixing the decorative sheet.
Figure 3:
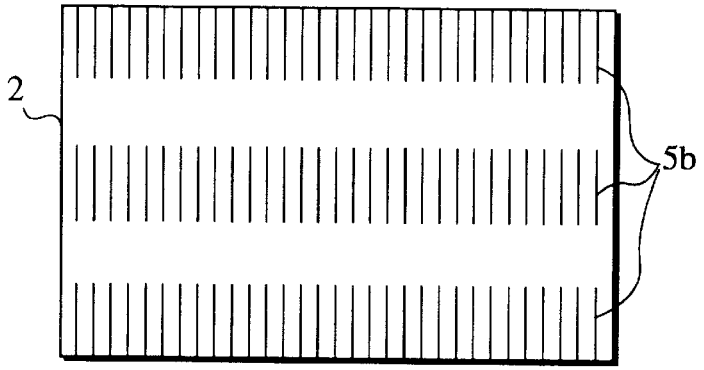
FIG. 3 is a bottom view showing a comb-like adhesive pattern used for affixing the decorative sheet.
Figure 4:
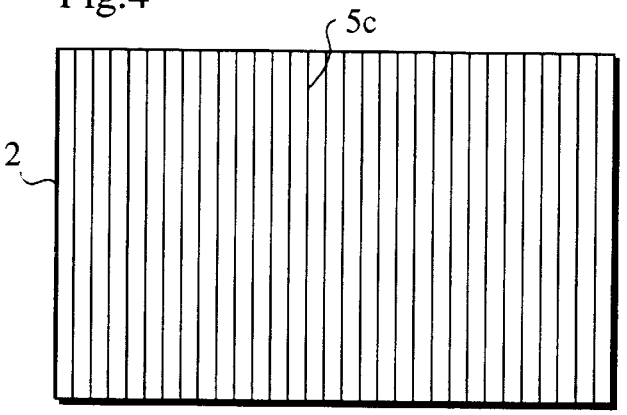
FIG. 4 is a bottom view showing a stripe adhesive pattern used for affixing the decorative sheet.

The uniform adhesive layer 5 may be replaced by a pattern of adhesive, as shown in FIGS. 2–4. Specifically, the uniform adhesive layer 5 may be replaced by a mesh adhesive pattern 5*a* (FIG. 2), or a comb-like adhesive pattern 5*b* (FIG. 3), or a stripe adhesive pattern 5*c* (FIG. 4). Obviously, the use of such an adhesive pattern is advantageous in that permeability to air and moisture is obtained even if the adhesive matrix material itself is not air- and moisture-permeable.

Figure 5:
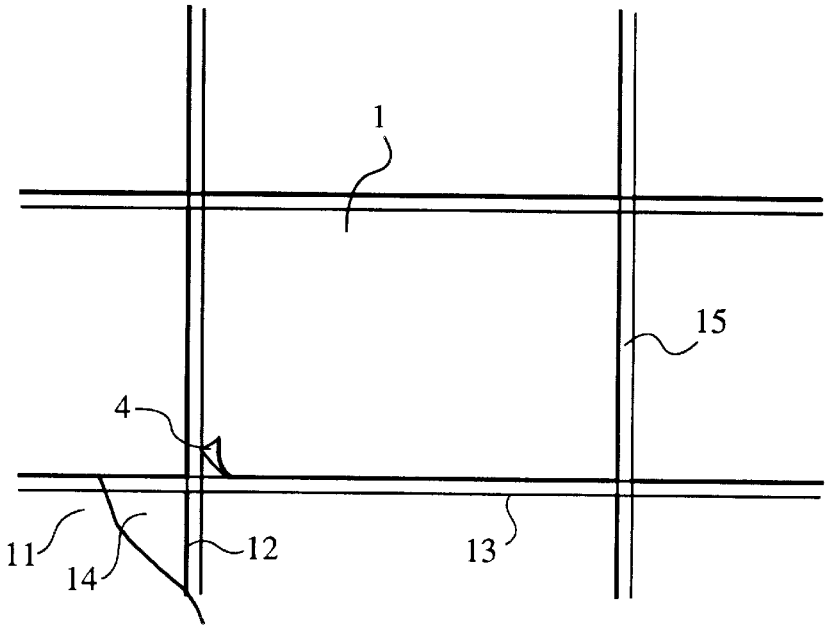
FIGS. 5 and 6 are front views showing successive steps of affixing the decorative sheet to a wall surface.
Figure 6:
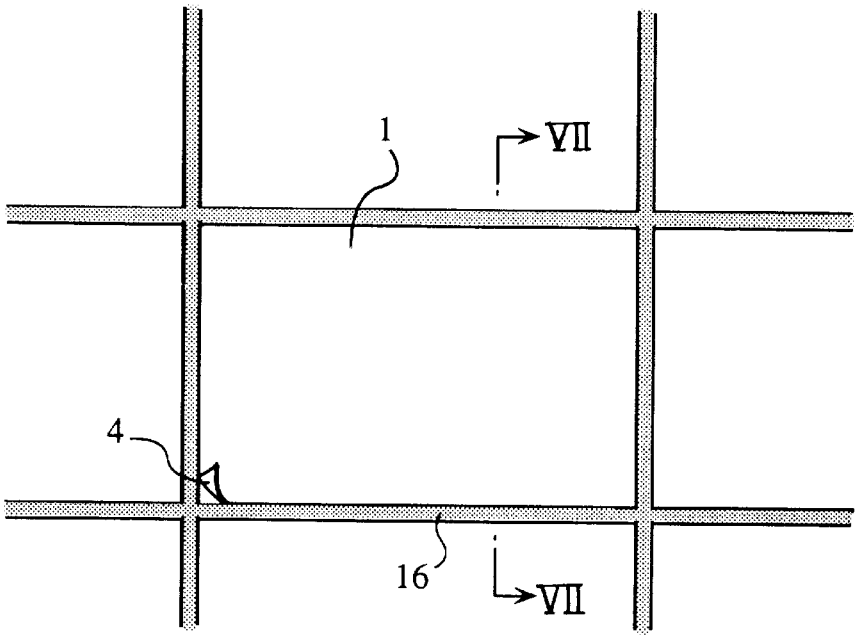
Figure 7:
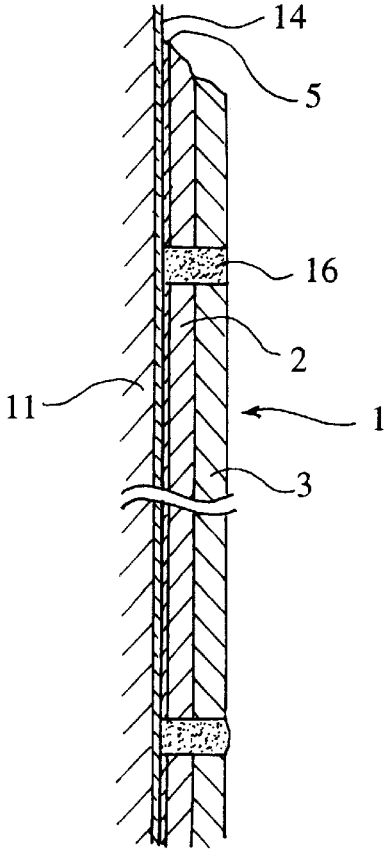
FIG. 7 is a sectional view taken along lines VII—VII in FIG. 6.

The decorative sheet 1 may be affixed to an exterior wall surface together with other similarly configured decorative sheets. FIGS. 5 to 7 show how the decorative sheets are affixed. In the illustrated example, each of the decorative sheets is rectangular with a size of 600 mm×400 mm.

First, as shown in FIG. 5, vertical partition lines 12 are marked on the exterior wall surface 11 at a constant interval of 610 mm. Similarly, horizontal partition lines 13 are formed at a constant interval of 410 mm.

Then, a contact adhesive 14 is applied all over the wall surface 11, and each of the decorative sheets 1 is affixed to a corresponding portion, defined by the respective partition lines 12, 13, of the wall surface 11, as also shown in FIG. 5. The decorative sheet thus affixed is uniformly pressed against the wall surface 11 by a stretching roller (not shown).

The contact adhesive 14 need be made permeable to air and moisture by the inclusion of a suitable additive, similarly to the adhesive layer 5 for the decorative sheet 1 (see FIG. 1). Otherwise, the contact adhesive need be applied in a mesh pattern (like FIG. 2) or a comb-like pattern (like FIG. 3) or a stripe pattern (like FIG. 4). Further, the contact adhesive 14 need be transparent or semitransparent for enabling visual recognition of the respective partition lines 12, 13.

Then, as shown in FIG. 6, a suitably colored sealant 16 is loaded in the clearances 15 (FIG. 5) between the respective decorative sheets 1. In this step, the plastic film 4 is still held attached to the coating layer 3 (FIG. 1) so that the coating layer will not be soiled or stained by the sealant 16. It should be appreciated that the wall surface 11 may be made to have an appearance of natural stone or rock by suitably selecting the colors of the coating layer 3 and the sealant 16.

Finally, the plastic film 4 is peeled off the coating layer 3 prior to curing of the sealant 16, as shown in FIG. 7. The surface decorating treatment will be complete when the sealant 16 is fully cured.

The decorative sheet 1 according to the illustrated embodiment is permeable to air and moisture as a whole. Thus, it is possible to prevent air from being locally trapped between the sheet and a wall surface. As a result, the decorative sheet 1 provides an improved uniform appearance while also preventing unexpected removal from the wall surface.

Further, the flexibility of the decorative sheet 1 facilitates an affixing operation even at corner portions of a wall surface or at bent or undulated surface portions. Moreover, the decorative sheet 1 can be easily cut to have any size and shape in addition to providing ready adaptation to edges of a wall surface.

The present invention being thus described, it is obvious to those skilled in the art that the same may be varied in many ways. For instance, the adhesive layer 5 may be completely omitted, and a suitable adhesive may be applied to one or both of the rear surface of the nonwoven fabric 2 and the wall surface at the site of affixing the decorative sheet 1 to the wall surface. Such variations are not to be regarded as a departure from the spirit and scope of the invention, and all such variations as would be obvious to those skilled in the art are intended to be included within the scope of the following claims.

What is claimed is:

1. A decorative sheet for an exterior wall surface comprising a flexible nonwoven fabric which is permeable to air and moisture and adapted to be adhered to an exterior wall surface, and a coating layer being also flexible and permeable to air and moisture after drying;

wherein the coating layer is made of a coating material which is prepared by mixing at least one matrix with at least one additive, said at least one matrix being selected from the group consisting of acrylic resin, copolymerized acrylic rubber, copolymerized butadien rubber, vinyl resin, urethane resin, silicone resin and fluorocarbon resin, said at least one additive being selected from the group consisting of natural stone powder, fine particles of natural stone, and artificially colored particles of natural stone, whereby the coating layer is made to have permeability to air and moisture without addition of a separate pore forming agent.

2. The decorative sheet according to claim 1, wherein the nonwoven fabric is made of at least one material selected from the group consisting of polyester fibers, polypropylene fibers, polyethylene fibers, nylon fibers, acrylic fibers, rayon fibers, acetate fibers and vinylon fibers.

3. The decorative sheet according to claim 1, wherein the coating layer is releasably covered by a plastic film.

4. The decorative sheet according to claim 3, wherein the plastic film is stretchable.

5. The decorative sheet according to claim 1, wherein the nonwoven fabric has a rear surface formed with a uniform adhesive layer which is permeable to air and moisture, the adhesive layer being covered by a releasable paper layer.

6. The decorative sheet according to claim 1, wherein the nonwoven fabric has a rear surface formed with a mesh adhesive pattern.

7. The decorative sheet according to claim 1, wherein the nonwoven fabric has a rear surface formed with a comb-shaped adhesive pattern.

8. The decorative sheet according to claim 1, wherein the nonwoven fabric has a rear surface formed with a stripe adhesive pattern.

9. A decorative sheet for an exterior wall surface comprising a flexible nonwoven fabric which is permeable to air and moisture and adapted to be adhered to an exterior wall surface, and a coating layer being also flexible and permeable to air and moisture after drying;

wherein the coating layer is made of a coating material consisting essentially of a matrix with an additive, said matrix being selected from the group consisting of acrylic resin, copolymerized acrylic rubber, copolymerized butadien rubber, vinyl resin, urethane resin, silicone resin and fluorocarbon resin, said additive being selected from the group consisting of natural stone powder, fine particles of natural stone, and artificially colored particles of natural stone.

* * * * *